US006092267A

United States Patent [19]

Covi et al.

[11] Patent Number: 6,092,267

[45] Date of Patent: Jul. 25, 2000

[54] SLIDE FASTENER

[75] Inventors: Christian Covi, Fritzens; Werner Steinlechner, Jenbach, both of Austria

[73] Assignee: D. Swarovski & Co., Wattens, Austria

[21] Appl. No.: 09/029,217

[22] PCT Filed: Jun. 6, 1997

[86] PCT No.: PCT/AT97/00115

§ 371 Date: Feb. 25, 1998

§ 102(e) Date: Feb. 25, 1998

[87] PCT Pub. No.: WO98/00040

PCT Pub. Date: Jan. 8, 1998

[30] Foreign Application Priority Data

Jun. 27, 1996 [DE] Germany ..... 296 11 270 U

[51] Int. Cl.[7] ..... A44B 19/02

[52] U.S. Cl. ..... 24/410; 24/431

[58] Field of Search ..... 24/387, 388, 390, 24/403, 409, 410, 416, 400, 399, 411, 417, 412, 427, 430, 431, 433, 434, 435

[56] References Cited

U.S. PATENT DOCUMENTS

| | | | |
|---|---|---|---|
| 2,525,284 | 10/1950 | Camp et al. . | |
| 2,720,015 | 10/1955 | Morin . | |
| 4,765,038 | 8/1988 | Kasai | 24/410 |
| 5,511,292 | 4/1996 | Covi et al. . | |

FOREIGN PATENT DOCUMENTS

| | | |
|---|---|---|
| 0 299 500 | 1/1989 | European Pat. Off. . |
| 1 413 576 | 11/1975 | Germany . |
| 1 479 363 | 7/1977 | Germany . |

*Primary Examiner*—James R. Brittain
*Attorney, Agent, or Firm*—Wenderoth, Lind & Ponack, L.L.P.

[57] ABSTRACT

A zipper closure including first and second rows of teeth formed on first and second bands. Each tooth has a free end in which a channel is formed. Each channel has a bottom which is convexly curved. The zipper closure includes a slider with a projection for opening and closing the zipper closure.

5 Claims, 2 Drawing Sheets

SLIDE FASTENER

BACKGROUND OF THE INVENTION

The invention concerns a zipper closure (fastener) having teeth made of a plastic material which are formed on two strips. Free ends of the teeth in one row extend into a fixing region of the other row of teeth, and the free ends are provided with channels.

A known zipper closure is described in German laid-open application (DE-OS) No 23 04 341. Since successive teeth of the zipper closure overlap practically over their entire lengths, it is relatively difficult to open the zipper closure. In order to exert an opening force onto a critical region of the zipper closure during opening of the zipper closure, it has already been suggested to provide bands of the zipper closure with a second bead or web on which the outer surface of a slider slides along. The bands are pulled apart due to the widening of the slider between its back end and its front end.

SUMMARY OF THE INVENTION

The aim of the present invention is to exert a force in an opening direction during opening onto teeth of a zipper closure of the kind set forth in the opening part of this specification by virtue of the configuration of a slider. The slider of the zipper closure is provided with a tapered projection which is arranged at the height of channels in the teeth. The tapered projection projects beyond a cross-piece which connects a top cover plate to a bottom cover plate of the slider. The channels have bottoms which are convexly curved in the plane of the teeth.

Therefore, the core of the invention lies in the combination of two features. One feature is that a projection, which is disposed at the height of the channels, must be arranged on the slider. Another feature is that the channels must extend towards a vertical centerline of the zipper closure to such an extent that the base of the channels moves behind a separating line when the teeth are inclined in the slider.

BRIEF DESCRIPTION OF THE DRAWINGS

Detail of the invention are explained with reference to the accompanying drawings.

DESCRIPTION OF THE PREFERRED EMBODIMENTS

Figure 1:
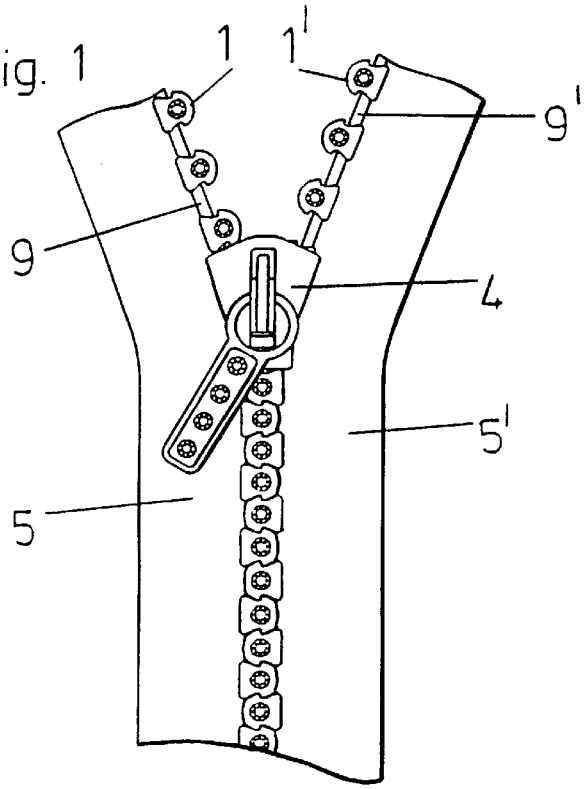
FIG. 1 is a top or elevation view of a zipper closure.

A zipper closure is shown in FIG. 1. The zipper closure comprises two bands 5, 5', on which teeth 1, 1' are arranged. Edge beads (webs) 9, 9' of the bands 5, 5' serve to support teeth 1, 1', and the teeth 1, 1' are attached to the beads 9, 9' by injection molding during production thereof. Decorative stones 3, for example made of lead crystal, are embedded at the same time. A slider 4 is used to open and close the zipper closure in the usual way.

Figure 2:
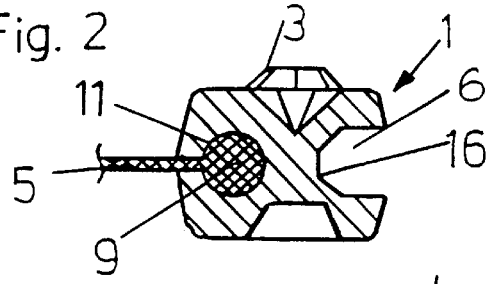
FIG. 2 is an enlarged longitudinal sectional view through a tooth.
Figure 3:
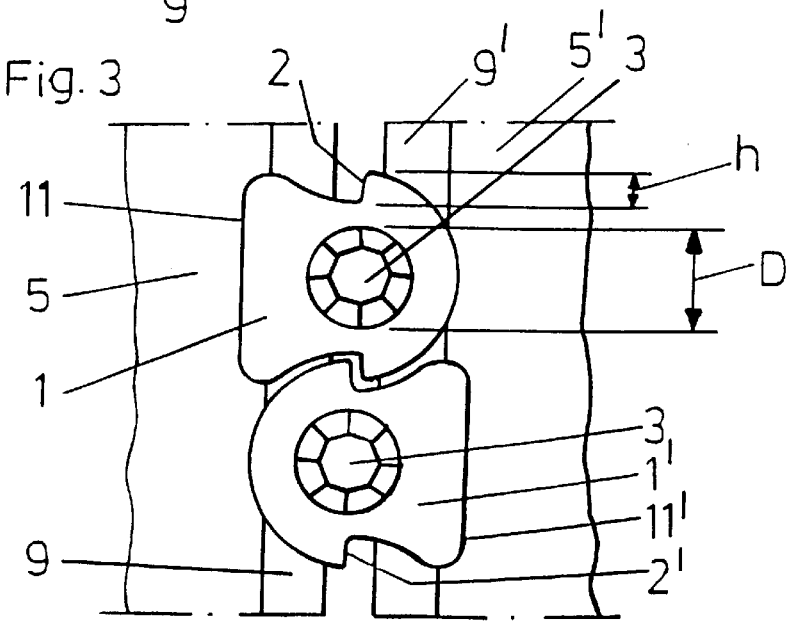
FIG. 3 is an enlarged top view of two adjacent teeth.

As can be seen from FIGS. 2 and 3, contact areas of the teeth 1, 1' confronting and abutting one another in the closed position are designed to have a prismatic shape such that the contact areas encounter no resistance to a vertical shifting of the teeth relative to one another (i.e., shifting in a direction perpendicular to the plane of FIG. 3), aside from friction. The teeth 1, 1' are anchored normal with respect to the bands 5, 5'. Channels (grooves) 6, 6' formed in free ends of the teeth 1, 1' receive the beads 9, 9' of the opposing band 5, 5'. So that this is possible, the teeth 1, 1' must have a length which approximately corresponds to the width of the closed zipper closure. Viewed from above each tooth 1, 1' starting from a base 11, 11' converges to a narrowest area or portion thereof, from which support surfaces 2, 2' extend outwardly nearly parallel to the bands 5, 5'. The free end of each tooth 1, 1' has approximately a half ellipse shape.

Decorative stones 3 can be arranged in a straight line. Spacing between the stones 3 is small in comparison with the sizes of the stones 3, if the support surfaces 2, 2" are kept correspondingly small. The support surfaces 2, 2" are kept small by the acute angling thereof relative to the direction of the teeth 1, 1'. In the illustrated embodiment, the length h of each support surface in a strip direction is approximately a third of the diameter D of the jewelry stones 3. This arrangement allows each jewelery stone 3 to be adequately surrounded by plastic material while nonetheless the spacing between successive stones 3 is small.

Figure 4:
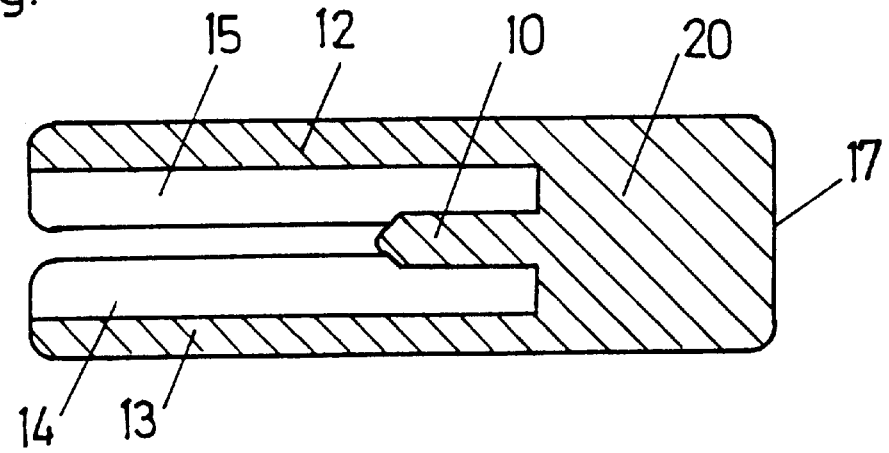
FIG. 4 is an enlarged vertical longitudinal sectional view through a slider.

The slider 4 is shown in a longitudinal sectional view in FIG. 4, and comprises top and bottom cover plates 12 and 13. Both side walls of the slider 4 respectively have upper and lower parts 14 and 15, which are divided by slits along their full lengths. The bands 5, 5' run through the slits, and the beads 9, 9' are supported by the inner surfaces of the upper and lower parts 14 and 15 of the side walls. A cross-piece 20 connects the top cover plate 12 to the bottom cover plate 13.

In order to exert a force on the teeth 1, 1' in an outward direction when opening the zipper closure, the crosspiece 20 is provided with a projection 10, which has a lance tip shape. The projection 10 extends beyond the end of the cross-piece 20 and is directed toward a narrow end of the slider 4. During opening of the zipper closure, this projection 10 engages the channels 6, 6' of the teeth 1, 1' and presses them into tracks lying on both sides of the cross-piece 20, which extend toward a wide end of the slider 4.

Figure 5:
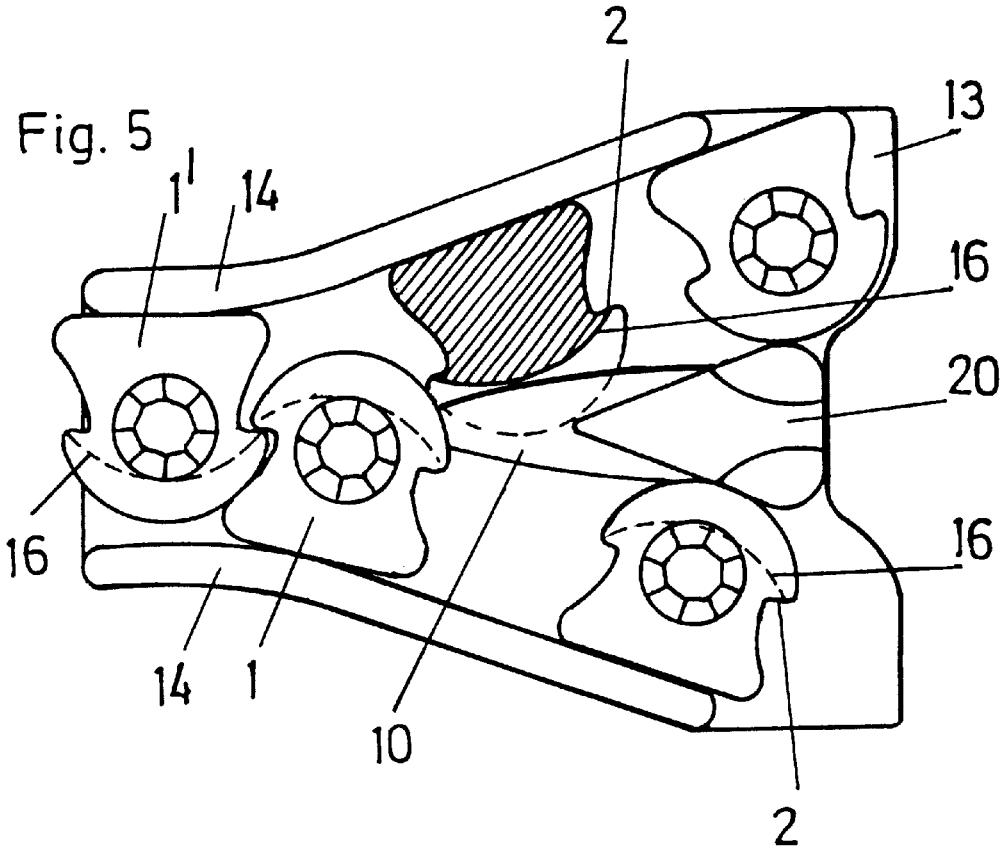
FIG. 5 is an enlarged top view of the zipper closure in which bands and a cover plate of the slider have been removed.

As shown in FIG. 5, bottoms 16 of the channels 6 provided at the free end of the teeth 1, 1' are curved between opposite sides of the teeth 1, 1' that face other teeth 1, 1'. This arrangement allows the projection 10 to be guided into the channels 6 and it prevents the projection 10 from colliding with vertical outside walls of the teeth 1, 1'.

Figure 6:
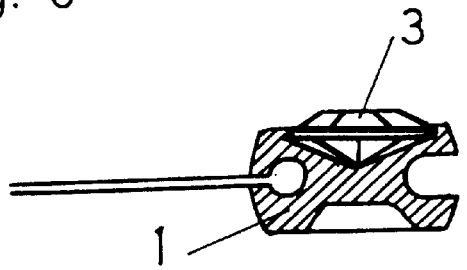
FIG. 6 corresponds to FIG. 2 for a second embodiment.

The invention makes it possible to produce zipper closures having very large teeth which are very decorative by virtue of the correspondingly large stone surfaces. Stones 3 must be securely embedded in plastic material with a minimum spacing from the grooves 6. A proportional increase in the size of the stone 3, as shown in FIG. 5, quickly causes the stone 3 to reach a minimum spacing limit. More specifically, the market does not want thick zipper closures because they make articles of clothing fitted therewith stiff and cause the clothing to lift away from the wearer. In order to remedy these disadvantages, flat stones 3 are used in conjunction with large teeth 1, 1'. The rear surfaces of the stones 3 converge to a point at an angle of at least 120°. Further, the rear surfaces of the stones 3 are coated with a reflective metal coating. The use of such stones results in the zipper closure being a flat structure, as shown in FIG. 6.

What is claimed is:

1. A zipper closure comprising first and second rows of teeth formed on first and second bands, said teeth having free ends, when said zipper closure is being closed said free ends of said first row of teeth extend into an area of attachment of said teeth of said second row of teeth and vice versa, each of said free end of said teeth having a channel formed therein, each of said channels has a bottom which is convexly curved between opposite sides of said teeth that face other said teeth, said zipper closure further comprising a slider with a top cover plate and a bottom cover plate connected by a cross-piece, said slider having a wider front end and a narrower back end, said cross-piece having a front end directed towards said wider front end of said slider and a back end directed towards said narrower back end of said slider, said cross-piece including a tapered projection extending beyond said back end of said cross-piece and directed towards said narrower back end of said slider, whereby upon opening of said zipper closure said projection engages in said channels of said teeth and an outwardly directed force is exerted on said teeth.

2. A zipper closure as set forth in claim 1 wherein said bottoms of said channels end at support surfaces of said teeth with which mutually oppositely disposed teeth bear against each other.

3. A zipper closure as set forth in claim 2 wherein said support surfaces extend outwardly from a narrowest region of said teeth in approximately parallel relationship with said first and second bands.

4. A zipper closure as set forth in claim 1 wherein when said zipper is closed said channels receive edge beads or webs of said first and second bands.

5. A zipper closure as set forth in claim 1 wherein into said teeth are fitted decorative stones, each of which has a front side and a rear side, each of said rear sides having surfaces disposed in mutually opposite relationship, which converge to form a point and which include an angle which is greater than 120°.

* * * * *